US009144899B2

(12) United States Patent
Bryant

(10) Patent No.: US 9,144,899 B2
(45) Date of Patent: Sep. 29, 2015

(54) ROLL CLAW

(76) Inventor: Thomas Bryant, Dahlonega, GA (US)

( * ) Notice: Subject to any disclaimer, the term of this patent is extended or adjusted under 35 U.S.C. 154(b) by 40 days.

(21) Appl. No.: 13/585,776

(22) Filed: Aug. 14, 2012

(65) Prior Publication Data

US 2014/0048755 A1 Feb. 20, 2014

(51) Int. Cl.

| | |
|---|---|
| ***B25C 11/00*** | (2006.01) |
| ***B66F 15/00*** | (2006.01) |
| ***B25C 11/02*** | (2006.01) |

(52) U.S. Cl.

CPC ..... *B25C 11/00* (2013.01); *B25C 11/02* (2013.01); *B66F 15/00* (2013.01)

(58) Field of Classification Search

USPC ..... 254/25

See application file for complete search history.

(56) References Cited

U.S. PATENT DOCUMENTS

| | | | | | |
|---|---|---|---|---|---|
| 112,401 | A * | 3/1871 | Winter | 254/25 |
| D4,811 | S * | 4/1871 | Christie | D8/89 |
| 4,774,862 | A * | 10/1988 | Scull | 81/119 |
| 5,495,651 | A * | 3/1996 | Tsuha | 29/235 |
| 5,671,644 | A * | 9/1997 | Anderson | 81/119 |
| 5,743,310 | A * | 4/1998 | Moran | 140/123.6 |
| 5,871,204 | A * | 2/1999 | Spirer | 254/26 R |
| 6,308,760 | B1 * | 10/2001 | Finzo et al. | 156/494 |
| 6,805,029 | B1 * | 10/2004 | Foster et al. | 81/186 |
| 6,913,246 | B1 * | 7/2005 | Skach | 254/25 |
| 7,140,275 | B1 * | 11/2006 | Staples | 81/119 |
| 7,591,208 | B2 * | 9/2009 | Cole | 81/177.8 |
| 7,628,382 | B2 * | 12/2009 | Cole | 254/25 |
| 8,424,845 | B2 * | 4/2013 | Cole | 254/26 R |
| 2006/0260445 | A1 * | 11/2006 | Cole | 81/177.8 |
| 2007/0169590 | A1 * | 7/2007 | Cole | 81/177.8 |

* cited by examiner

*Primary Examiner* — Lee D Wilson
*Assistant Examiner* — Alvin Grant
(74) *Attorney, Agent, or Firm* — Johnson, Marcou & Isaacs, LLC

(57) ABSTRACT

The roll claw is a complementary tool with a purpose of using less stress force to do work. The roll claw is configured with a rounded head and a claw end. The roll claw has a square portal that accepts a ratchet or pull handle of various sizes, and a round portal that accepts a chain link of any make where a tension strap with a hook can be attached. The roll claw uses leverage to reduce the stress force to perform certain work.

4 Claims, 4 Drawing Sheets

ROLL CLAW

FIELD OF THE DISCLOSURE

The present disclosure relates generally to a device used as a tool that utilizes leverage to reduce the stress force to perform certain work.

SUMMARY

The roll claw is a complementary tool with a purpose of using less stress force to do work. The roll claw is configured with a rounded head and a claw end. The roll claw has a square portal that accepts a ratchet or pull handle of various sizes, and a round portal that accepts a chain link of any make where a tension strap with a hook can be attached. The roll claw uses leverage to reduce the stress force to perform certain work.

The foregoing and other features will become more apparent from the following detailed description of several embodiments, which proceeds with reference to the accompanying figures.

DETAILED DESCRIPTION

Figure 1:
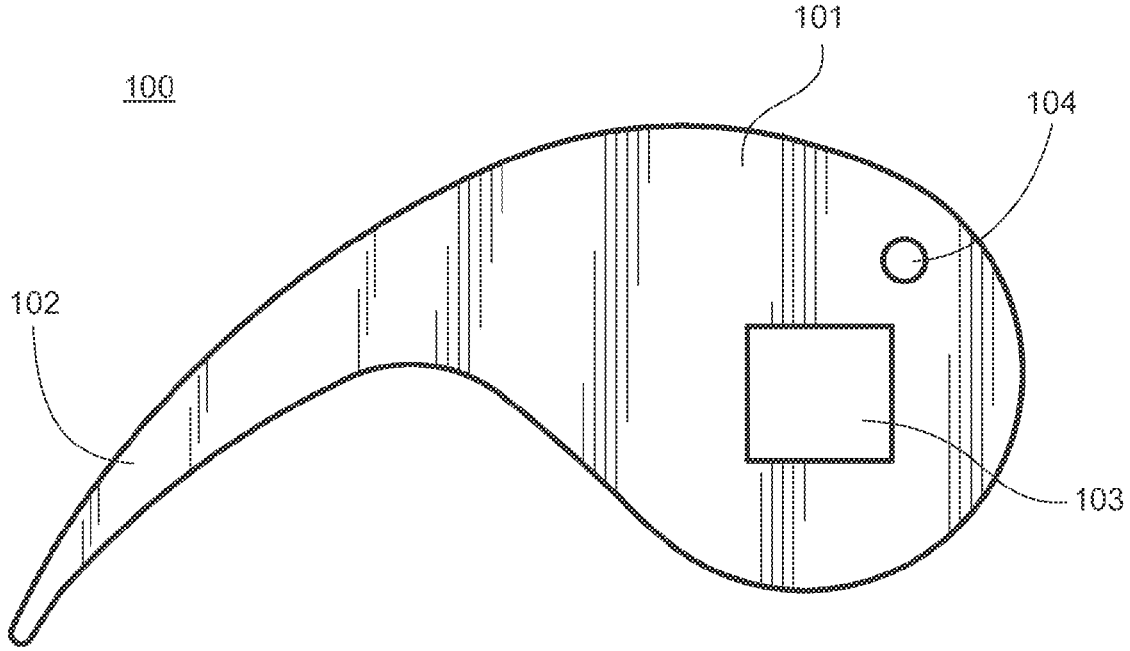
FIG. 1 is a side view of an exemplary roll claw.

This disclosure addresses the problem where a person needs to use leverage to reduce the stress force to perform certain work. Since less force is required to apply the leverage, persons exerting limited force would be able to perform tasks, such as removing nails or separating two items. When a longer handle is used with the roll claw, less force is needed. When a shorter handle is used, the roll claw may be utilized in confined spaces or other spaces with less room for operating a tool.

Referring first to FIGS. 1-4, there is shown a roll claw 100. According to one embodiment, FIGS. 1-4 illustrate a rounded end 101 of the body of the roll claw 100, a claw portion 102 of the body of the roll claw 100, a square portal 103 in the body of the roll claw 100, and a round portal 104 in the body of the roll claw 100.

FIG. 1 is a side view of the exemplary roll claw 100, in accordance with certain example embodiments. The square portal 103 and the round portal 104 are shown in the rounded end 101 of the body of the roll claw 100. The rounded end 101 is shown opposite the claw portion 102 of the roll claw 100. The claw portion 102 is described in greater detail in the description of FIG. 4.

The square portal 103 is shown as being a void in the body of the roll claw 100 through which a user can insert a ratchet or other pull bar. The square portal 103 in the roll claw 100 will be made in sizes to accommodate a ratchet or pull bar, of any make, in the sizes 0.377, 0.502 and 0.752 inches.

The round portal 104 is also illustrated in FIG. 1. The round portal 104 in the roll claw 100 accepts a chain link pin. The chain link pin is used to attach a pull strap with an attached hook. With a strap attached to the roll claw 100, objects that are round or square can be rotated or lifted without scarring the surface of the object. In an example, the pull strap may be used to rotate or lift large pipes, columns, or filters of all sizes. In an example, the round portal 104 is 0.160 inches in diameter and accepts a 0.156 inch chain link pin.

In an example, the roll claw 100 of FIG. 1 is constructed as a single item. In an example, the roll claw 100 has an R. C. hardness range of 42-44. In an example, the length of the roll claw 100 is 4 inches, the width is 0.678 inches, and the height is 1.200 inches.

Figure 2:
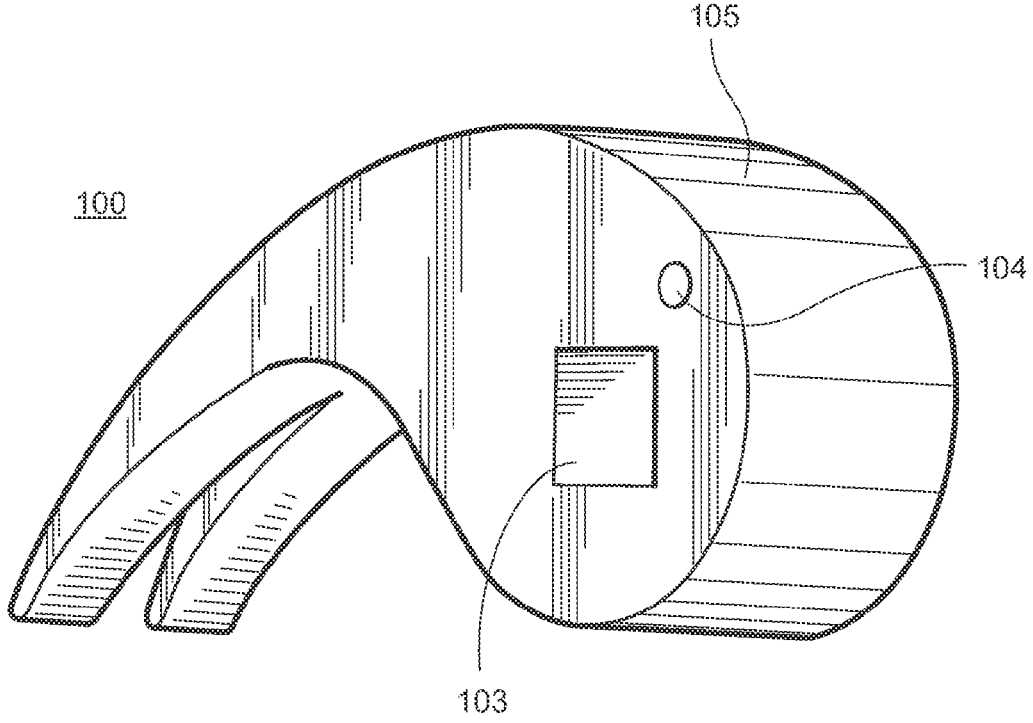
FIG. 2 is a side perspective view of an exemplary roll claw.

FIG. 2 is a side perspective view of the exemplary roll claw 100, in accordance with certain example embodiments. The square portal 103 and the round portal 104 are shown in the rounded end 101 of the body of the roll claw 100. The rolling surface 105 of the roll claw 100 is shown.

Figure 3:
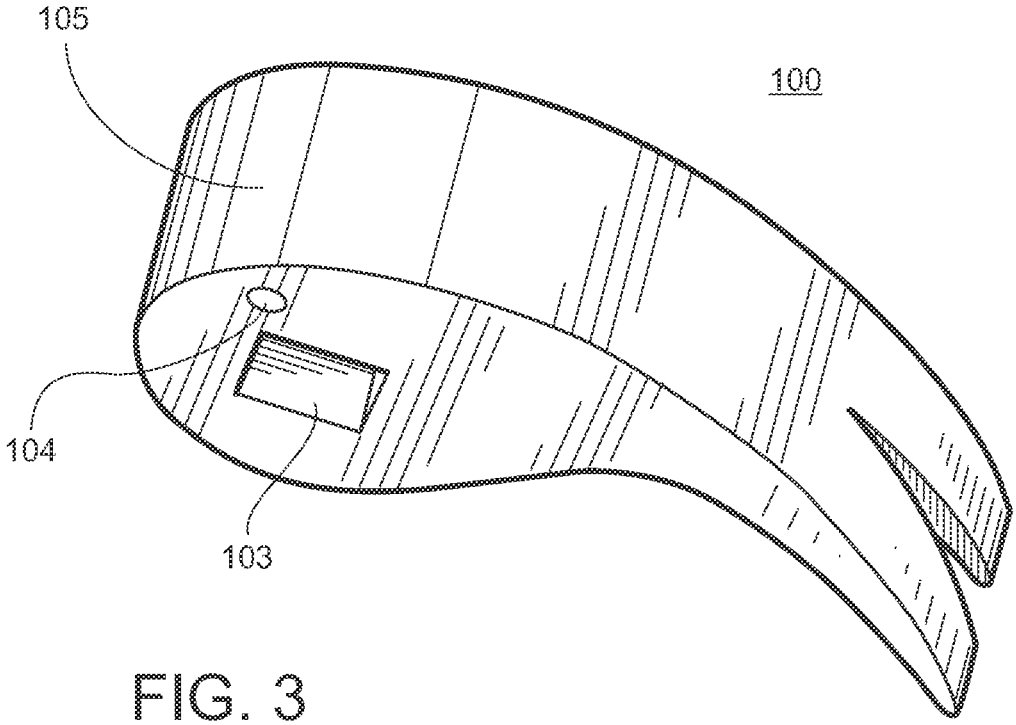
FIG. 3 is a bottom perspective view of an exemplary roll claw.

FIG. 3 is a top perspective view of the exemplary roll claw 100, in accordance with certain example embodiments. The square portal 103 and the round portal 104 are shown in the rounded end 101 of the body of the roll claw 100. The rolling surface 105 of the roll claw 100 is shown. As shown in FIG. 3, the curve of the rolling surface 105 of the roll claw 100 is more pronounced at the rounded end 101 of the roll claw 100. For example, the rounded end 100 of the roll claw 100 may be approximately a semicircle with a diameter approximately 1.2 inches. The curve of the rolling surface 105 is lessened on the top surface as the rolling surface moves to the claw portion 102 of the roll claw 100 as shown in FIG. 3. Thus, the curve of the rolling surface 105 is more rounded on the rounded end 101 and less rounded on the claw portion 102. The rolling surface 105 being rounded in a manner that allows the leverage of a force being applied by the roll claw 100 to increase as the roll claw 100 is rolled away from the claw portion 102 of the roll claw 100.

Figure 4:
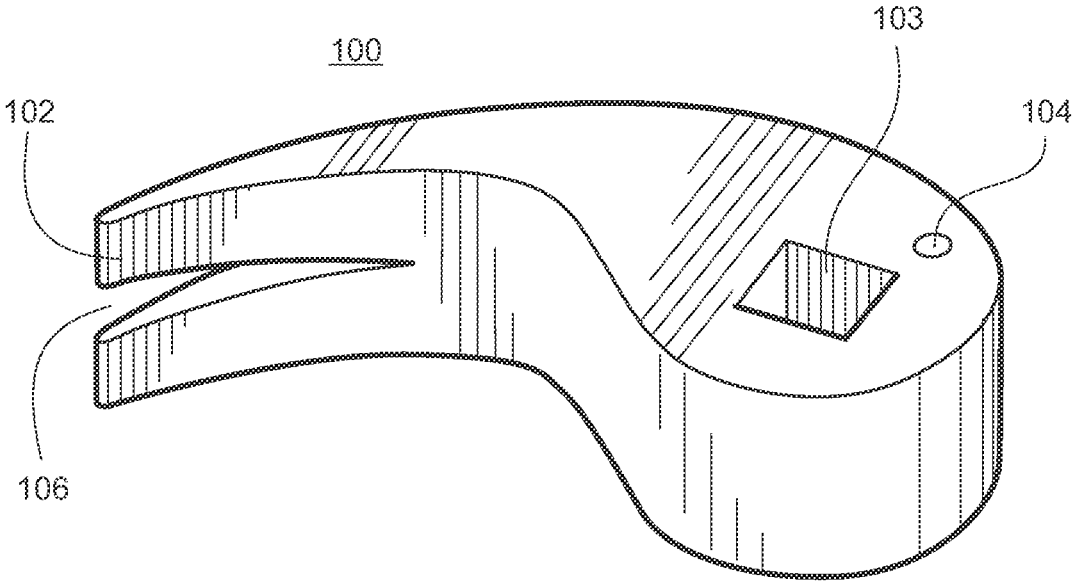
FIG. 4 is a top perspective view of an exemplary roll claw.

FIG. 4 is a side perspective view of the exemplary roll claw 100, in accordance with certain example embodiments. The square portal 103 and the round portal 104 are shown in the rounded end 101 of the body of the roll claw 100. The claw portion 102 of the roll claw 100 is shown.

The claw portion 102 of the example embodiment is shown with the claw portion 102 split into two diverging portions. The two diverging portions form a void that becomes wider towards the edge of the claw portion 102 and narrower towards the center of the roll claw 100.

Figure 5:
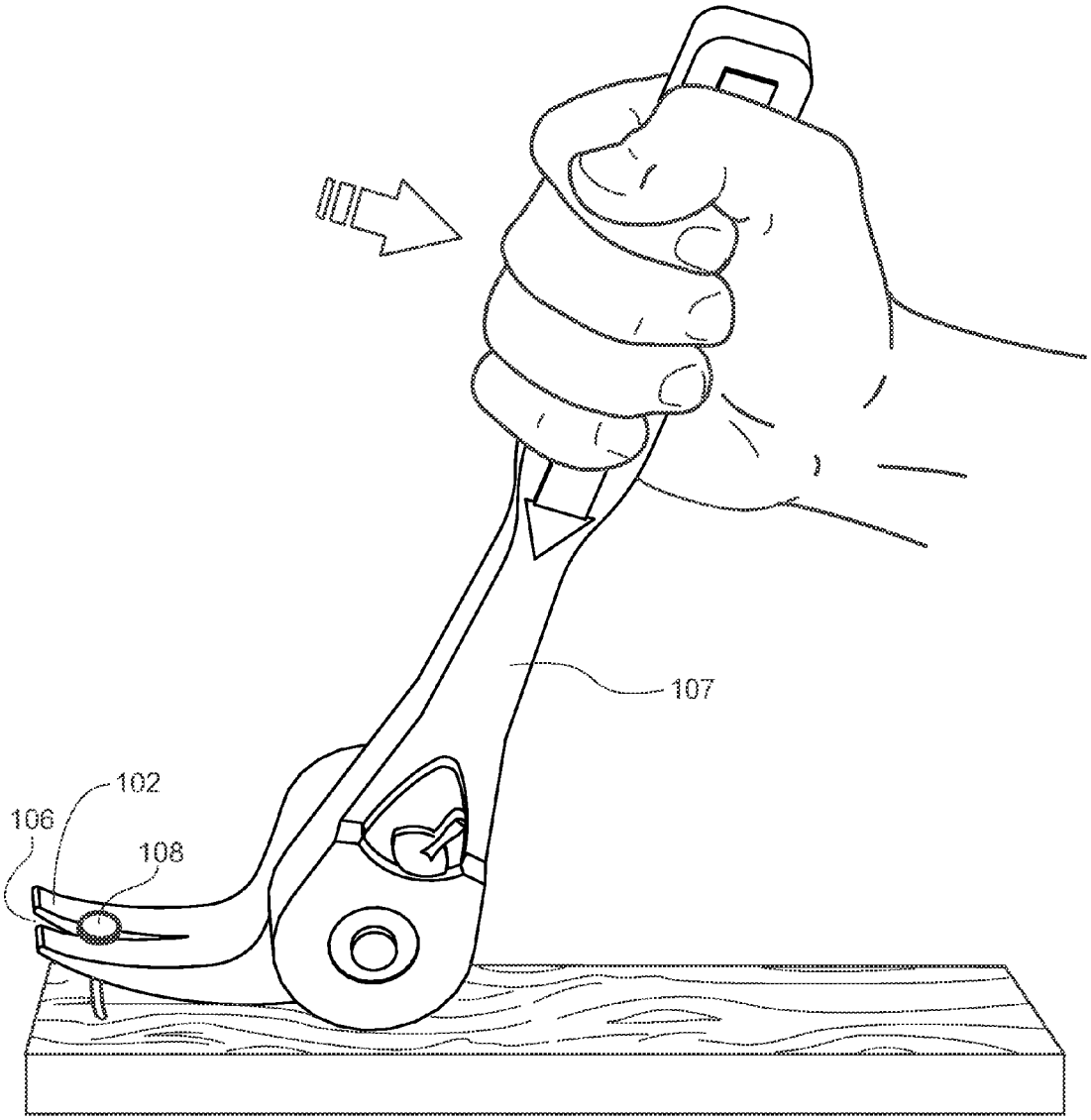
FIG. 5 is a side perspective view of an exemplary roll claw with a ratchet attached in the act of leveraging a nail from a board.

FIG. 5 is a side perspective view of an exemplary roll claw 100 with a ratchet 107 attached in the act of leveraging a nail 108 from a board. In the example, the ratchet 107 connector is inserted into the square portal 103 of the roll claw 100.

Figure 6:
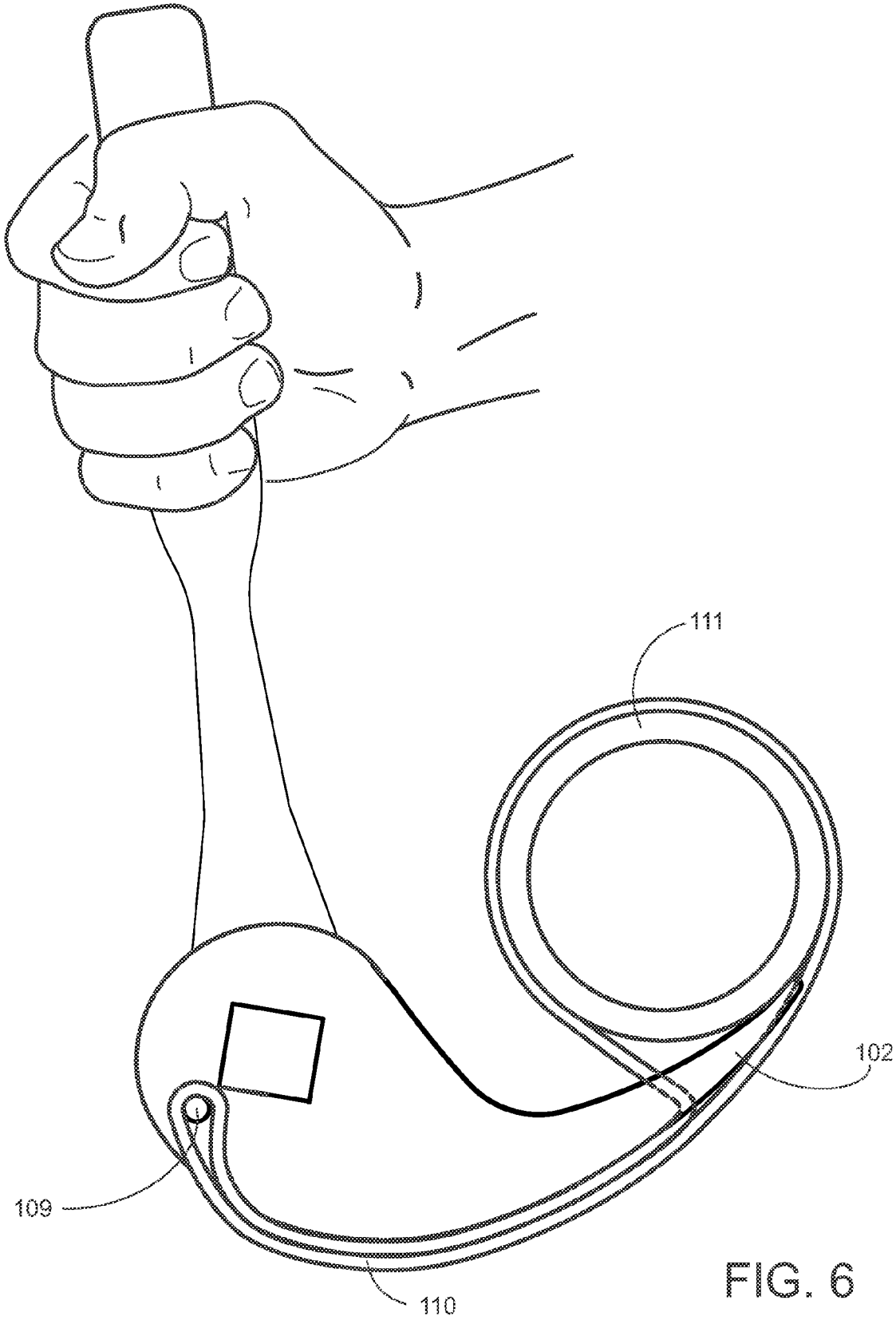
FIG. 6 is a side view of an exemplary roll claw with a pull strap attached.

FIG. 6 is a side view of an exemplary roll claw 100 with a pull strap 110 attached. In the example, the roll claw 100 has a chain link pin 109 affixed to the round portal 104. The pull strap is affixed to the chain link pin to secure the pull strap 110 to the roll claw 100. The pull strap 110 is looped around a pipe 111, or other body, to move or twist the body.

The invention claimed is:

1. An apparatus that exerts leverage, comprising a body comprising a rounded portion on an end of the body and a claw portion on an opposite end of the body, the rounded portion comprising a portal to receive a pull bar to removably attach the pull bar to the body, and the claw portion comprising diverging portions, the diverging portions forming a void that becomes wider towards an outer edge of the claw portion, the body further comprising a round portal that receives a pin attaching a pull strap to the body.

2. The apparatus of claim 1, wherein the pull bar is a ratchet.

3. The apparatus of claim 1, wherein the portal has a square shape, and where the pull bar is a ratchet.

4. The apparatus of claim 1, further comprising the pull bar coupled to the apparatus.

* * * * *